US007077271B1

(12) United States Patent
Hamilton

(10) Patent No.: US 7,077,271 B1
(45) Date of Patent: Jul. 18, 2006

(54) SECONDARY SCREEN FOR CONCRETE PUMP

(76) Inventor: Van Acosta Hamilton, 600 Alexander Ct., Suisun City, CA (US) 94585

( * ) Notice: Subject to any disclaimer, the term of this patent is extended or adjusted under 35 U.S.C. 154(b) by 366 days.

(21) Appl. No.: 10/609,189

(22) Filed: Jun. 27, 2003

(51) Int. Cl.
*B07B 1/49* (2006.01)

(52) U.S. Cl. ..... 209/634; 209/680; 209/320; 209/325; 209/420; 209/421; 209/348; 209/931; 134/104.4; 134/111

(58) Field of Classification Search ..... 209/634, 209/680, 309, 325, 420, 421, 931
See application file for complete search history.

(56) References Cited

U.S. PATENT DOCUMENTS 3,254,765 A * 6/1966 Mogensen ..... 209/316
3,886,063 A * 5/1975 Friesz ..... 209/44
4,016,978 A * 4/1977 Danna, Jr. ..... 209/2
4,792,234 A * 12/1988 Doherty ..... 366/14
5,127,740 A * 7/1992 DeBoer ..... 366/2
5,294,001 A * 3/1994 Dulin ..... 209/3
5,622,266 A * 4/1997 Curtis ..... 209/235
6,155,277 A * 12/2000 Barry ..... 134/104.4
6,354,439 B1 * 3/2002 Arbore ..... 209/421
6,446,813 B1 * 9/2002 White ..... 209/365.4
6,782,925 B1 * 8/2004 Raposo et al. ..... 141/5
6,783,007 B1 * 8/2004 Arbore ..... 209/421
6,866,047 B1 * 3/2005 Marvin ..... 134/22.1

* cited by examiner

*Primary Examiner*—Donald R. Walsh
*Assistant Examiner*—Jonathan R Miller
(74) *Attorney, Agent, or Firm*—Risto A. Rinne, Jr.

(57) ABSTRACT

An apparatus for the removal of objects and other debris from cement that is pumped via a concrete pump includes a secondary screen that is pivotally attached at one end thereof to a concrete pump a predetermined distance above a grate that is disposed over a hopper, the screen having a smaller opening size than that of the grate. An opposite end of the screen is urged toward an opposite end of the hopper by a pair of elastomeric straps. A pair of upraised sides are included at a top and bottom of the screen, the screen having a planar member that is disposed at a steeper angle than is the grate. When cement is poured it first contacts and passes through the secondary screen which automatically descends and rises, thereby maximizing the flow rate of cement through the screen as the objects are removed from the mixture.

5 Claims, 1 Drawing Sheet

SECONDARY SCREEN FOR CONCRETE PUMP

BACKGROUND OF THE INVENTION

1. Field of the Invention

The present invention, in general relates to pumping cement and, more particularly, to a filter screen for use with a concrete pump.

It is common to pump cement at various job sites because the cement truck cannot directly access the location where the cement is to be poured. It is common to use a trailerable pump to convey the cement where desired. A trailerable pump includes an engine that drives a pump. Cement is deposited by the cement truck through a large (primary) grate into a hopper and the pump urges the cement through a hose that is routed to where the cement is needed. The trailerable pump is attached to a trailer (bed) and is towed to and from each job site as needed. This type of equipment is commonly referred to as a "trailerable cement line-pump" or more simply as a "trailerable line-pump".

One problem involving the use of the trailerable line-pump is caused by impurities in the cement mixture. Because the mixture is not as consistent as is desirable the inconsistencies can cause a clog to occur in the hose. For example, a typical mixture of cement that is being delivered in the cement truck might be what is called "three-quarter rock and pea gravel" mix meaning the cement includes rock ranging typically from ¾ to 1 inch in diameter and/or pea gravel ranging in size from ⅜ to ½ of an inch in diameter. If the rock size is not larger than this size then there is usually no problem pumping the cement mixture through the hoses.

However, sometimes larger and even much larger rocks can be present in the mixture that can clog the hose. The primary grate that may be included with the trailerable line-pump is not able to prevent the passage of these objects because its opening size is too large, for reasons as are discussed hereinbelow that relate to flow rate. Accordingly, the primary grate that may be included is useful in preventing the passage of only the largest of objects that are several inches or more in diameter.

The typical solution to this problem at the job site is to take a sledge hammer and literally pound an obstruction (i.e., the rock causing the obstruction) that is causing a clog in the hose until the rock is crushed to a small enough size so that it can then be pumped downstream in the hose along with the rest of the cement mixture.

This process requires repeated pounding on the outside of the hose at the location of the obstruction and it is especially damaging to the hose which can cause considerable fraying on the inside of the hose. The frayed parts (i.e., cords) then tend to accumulate cement which dry in thicker and thicker layers with each subsequent usage until the cement-covered frayed cord area can itself either cause or contribute to another blockage occurring in the hose and a repetition of the pounding and further fraying of the hose until the hose is ruined.

Not only are larger than normal rocks sometimes present in the cement mixture, but all manner of objects can also be found to occur in the mixture, for example tools like pliers, sometimes find their way into the mixture. Once these are objects are deposited in the hopper of the trailerable line-pump they can damage the pump and obstruct the hose, as well. All manner of objects can cause obstructions in the hose with the same remedy as was described hereinabove.

The use of a sledgehammer to pound the hose damages the hose and this increases the frequency of hose replacement and therefore also the cost of operating a trailerable cement line pump.

The use of a simple screen placed over the hopper is ineffective for a number of reasons. The screen can collect fiber hairs, as are commonly used in cement mixtures, and clog. It is difficult to remove known types of screens to facilitate the cleaning of the fiber hairs off of them.

Also, it is difficult to select an effective screen size. The words "screen" and "grate" are used interchangeably herein. Too large of a screen size allows too large of an object to pass through which can clog the hose or damage the pump. A smaller screen size, while preferable to limit object size, fails in that it restricts the flow rate of cement into the hopper. The cement truck operators are under time pressure to deliver the cement and leave and are generally unwilling to wait in order to accommodate a slow pour rate.

A smaller screen size is also especially prone to clogging in that the objects that are retained tend to accumulate all along the surface.

Similar problems occur with truck mounted pumps and with boom pumps. Boom pumps include an extendable boom for remotely accessing a pour site over an obstruction. The instant invention is applicable for all such uses.

Another problem when pumping concrete is that sometimes the cement (concrete) is not uniformly mixed. Dry patches may exist and these are known as either "dry packs" or sometimes as "meatballs" because of their shape. Meatballs can obstruct the pumping process as much as can any sort of an obstruction present in the concrete mix. Therefore, it is important to be able to remove them as well.

Accordingly, there exists today a need for a secondary screen for a concrete pump that filters larger objects while allowing for higher flow rates.

Clearly, such an apparatus would be a useful and desirable device.

2. Description of Prior Art

Trailerable line-pumps, truck mounted concrete pumps, and boom pumps that include a hopper and a large grate are, in general, known. While the structural arrangements of the above described devices, may at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a secondary screen for a concrete pump that can accommodate delivery of cement from any angle.

It is also an important object of the invention to provide a secondary screen for a concrete pump that includes a screen that is suspended above a grate.

Another object of the invention is to provide a secondary screen for a concrete pump that includes a screen that is adapted to pivot about an axis.

Still another object of the invention is to provide a secondary screen for a concrete pump that includes a pitch angle sufficient to direct retained objects away from a center thereof.

Still yet another object of the invention is to provide a secondary screen for a concrete pump that includes a pair of first and second upraised sides that are disposed in a spaced apart relationship on opposite sides of a lower planar screen member.

Yet another important object of the invention is to provide a secondary screen for a concrete pump that includes an elastomer to retain one end of an elevated screen a predetermined distance above a hopper.

Still yet another important object of the invention is to provide a secondary screen for a concrete pump that is economical to manufacture.

A first additional important object of the invention is to provide a secondary screen for a concrete pump that can be retrofitted for use with existing concrete pumps.

A second additional important object of the invention is to provide a secondary screen for a concrete pump that can be removed for easy cleaning.

A third additional important object of the invention is to provide a secondary screen for a concrete pump that is useful in reducing the amount of "dry pack" or "meatballs" that enter into a conduit used for pumping concrete.

Briefly, a secondary screen for use with a concrete pump that is constructed in accordance with the principles of the present invention has a planar member with a predetermined opening size that is small enough to prevent the passage of unwanted objects. A first and a second upraised side are disposed in a spaced apart relationship on an opposite first and second side respectively of the planar member. The first upraised side at an end thereof that is opposite to where it is attached to the planar member is hingedly attached to a portion of the line-pump that is disposed above a hopper. A second side of the planar member is urged by elastomeric means toward an opposite side of the hopper so that the second side is lower than the first side and to provide the planar member with an angle greater than any that is present at the top surface of the hopper. The ends of the planar member intermediate the first and second upraised sides are open. When a cement mixture is poured it first contacts the secondary screen which depresses downward from the initial weight and impact of the cement. The elastomeric means then urge the secondary screen upward. This up and down motion allows for an optimum (i.e., fast) flow rate of the cement mixture through the secondary screen because the cement's velocity as it is poured relative to the secondary screen increases when the secondary screen begins to rise upward. Objects that are separated are automatically conveyed toward the second upraised side by both the angle of the planar member and also by the up and down motion where they accumulate and are eventually agitated sufficient so as to urge them off either open end of the planar member. As more cement is poured the secondary screen is repeatedly urged down, then up again thereby optimally separating unwanted objects from the mixture while permitting a maximal flow rate to occur.

DETAILED DESCRIPTION OF THE INVENTION

Figure 1:
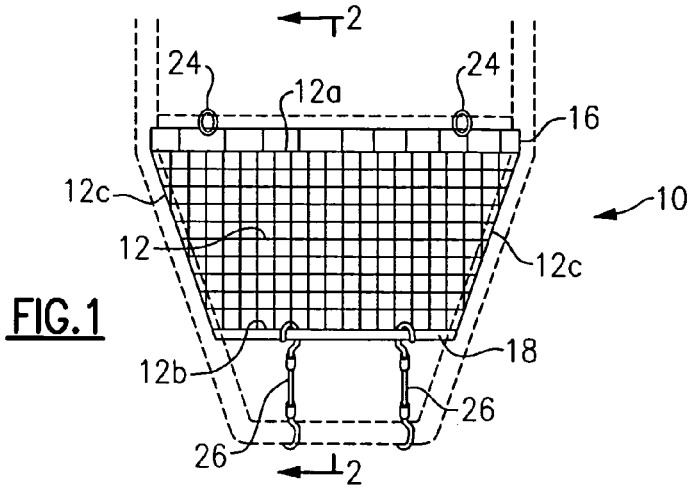
FIG. 1 is a top view of a secondary screen for a concrete pump disposed over a line-pump (dashed lines).
Figure 2:
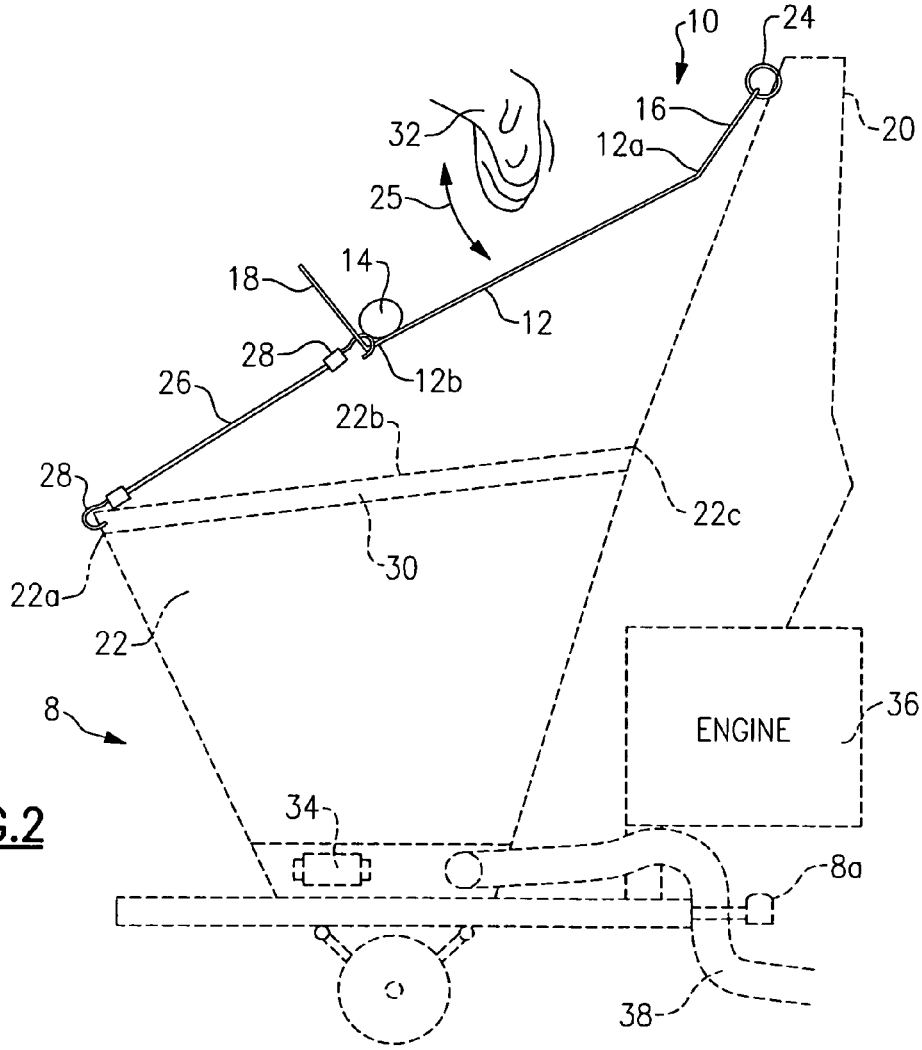
FIG. 2 is a cross sectional view taken on the line 2—2 in FIG. 1.

Referring to FIG. 1 and to FIG. 2 is shown, a secondary screen for a concrete pump, the secondary screen identified in general by the reference numeral 10. The concrete pump is shown in dashed lines and is identified in general by the reference numeral 8 (FIG. 2).

The secondary screen 10 has a planar member 12 with a predetermined opening size that is small enough to prevent the passage of an unwanted object 14. A preferred opening size is not larger than 1 and ⅛ inches wide by 2 and ⅞ inches long.

A first upraised side 16 is attached to a first side 12*a* of the planar member 12. A second upraised side 18 is attached to a second opposite side 12*b* of the planar member 12.

The first upraised side 16 at an end thereof that is opposite to where it is attached to the first side 12*a* of the planar member 12 is hingedly attached to an upraised portion of the line-pump 20 (dashed lines) that is disposed above a hopper 22. The upraised portion of the line-pump 20 is disposed toward the front of the concrete pump 8 where a trailer hitch 8*a* is disposed.

A pair of loops 24 that are attached to the upraised portion of the line-pump 20 encircle around the end thereof of the first upraised side 16A and allow for up and down pivoting motion of the secondary screen 10 relative to the upraised portion of the line-pump 20 as shown by arrow 25 and as is discussed in greater detail hereinafter.

The second side 12*b* of the planar member is urged by a pair of elastomeric bands 26 toward an opposite side 22*a* of the hopper 22 so that the second side 12*b* is lower than the first side 12*a* and to provide the planar member 12 with an angle greater than any that is present at a top surface 22*b* of the hopper 22. The elastomeric bands 26 include a pair of hooks 28 at each end, one hook 28 being attached to the second side 12*b* and the remaining hook being attached to the opposite side 22*a* of the hopper 22. Springs (not shown) could be substituted for the elastomeric bands 26, however springs are prone to accumulate debris and cement or rust and therefore are not as desirable as are the elastomeric bands 26.

In particular, the hopper 22 has a first side 22*c* that is disposed nearest the upraised portion of the line-pump 20. The hopper 22 may include a grate 30 that includes a larger opening size than that of the secondary screen 10.

The pitch of the top surface 22*b* relative to level ground is less than the pitch of the planar member 12 when the secondary screen 10 is quiescent (i.e., at rest). The greater angle of the planar member 12 is useful in conveying the object 14 away from the center of the planar member 12 and, by use of gravity and motion, toward the second upraised side 18 where the object 14 is prevented from rolling further down toward the elastomeric bands 26.

A pair of ends 12*c* of the planar member intermediate the first and second upraised sides 16, 18 are open. When a cement mixture 32 is poured it first contacts the secondary screen 10 which depresses downward from the initial weight and impact of the cement 32. The elastomeric bands 26 then urge the secondary screen upward according to arrow 25.

This up and down motion allows for an optimum (i.e., fast) flow rate of the cement mixture 32 through the secondary screen 10 because the cement's 32 velocity as it is poured relative to the secondary screen 10 increases when the secondary screen begins to rise upward. This provides an increase in inertia that forces the cement 32 through the secondary screen 10 faster than if the secondary screen 10 were stationary.

The objects 14 that are separated are automatically conveyed toward the second upraised side 18 by both the angle of the planar member 12 and also by the up and down motion where they accumulate and are eventually agitated an amount that is sufficient so as to urge them off either open end 12*c* of the planar member 12.

As more cement 32 is poured the secondary screen 10 is repeatedly urged down and then up again, thereby optimally separating the unwanted objects 14 from the cement mixture 32 while permitting a maximal flow rate to occur. Of course, the objects 14 must include a dimension (i.e., a diameter) that is greater than the opening size of the planar member 12 in order to be retained.

The cement 32 pours down through the grate 30 and into the bottom of the hopper 22 where a pump 34 that is driven by an engine 36 is used to convey the cement 32 that has had all of the objects 14 removed that were in the cement mixture 32 by the secondary screen 10. The cement 32 is urged to move through a hose 38 to where it is desired for use.

The overall size and shape of the secondary screen 10 is varied to accommodate the size and shape of the hopper 22. A preferred shape for the planar member 12 for a particular model of trailerable line-pump 8 is that of a trapezoid with the longer leg (12*a*) being disposed at a higher elevation than the shorter leg (12*b*) and toward the front of the concrete pump 8.

The secondary screen 10 is able to receive the cement mixture 32 from a delivery cement truck (not shown) regardless of the angle of a chute (not shown) that is attached to the truck and used to convey the cement 32.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A secondary screen for a trailerable concrete pump, comprising:

(a) said secondary screen including a length and a width and an opening size that prevents the passage of an object having a dimension larger than that of said opening size through said secondary screen; and (b) hingedly attaching said secondary screen at a first end thereof to said trailerable concrete pump and at a predetermined distance above a hopper of said trailerable concrete pump; and (c) wherein when said secondary screen is hingedly attached to said trailerable concrete pump, said secondary screen is disposed above a grate that is attached proximate to said hopper and wherein said opening size of said secondary screen is smaller than an opening size of said grate, and (d) wherein when said secondary screen is disposed in a position adapted for use, said secondary screen is disposed at an angle with respect to a level plane of the earth and wherein said secondary screen is hingedly attached to said trailerable line pump and wherein said secondary screen includes said first end and an opposite second end, and wherein when said secondary screen is disposed in a position adapted for use, said second end is higher than said first end, and wherein said secondary screen is adapted to permit said object to fall off of said secondary screen and not to fall on said grate.

2. The secondary screen of claim 1 including a pair of loops attached to said trailerable line pump and to said secondary screen and wherein said secondary screen is adapted to pivot about an axis passing through said pair of loops.

3. The secondary screen of claim 2 including means for applying a force attached to said second end of said secondary screen and to said trailerable line pump sufficient to permit said second end of said secondary screen to pivot about said axis in a first downward direction a predetermined distance in response to a weight of concrete that is poured on said secondary screen and wherein after said means for applying a force has been sufficiently extended, said means for applying a force is adapted to prevent a further urging of said second end of said secondary screen in said first downward direction and wherein said means for applying a force is adapted to urge said second end of said secondary screen in an opposite second, upward direction until a force applied by said weight of concrete is sufficient to stop said second end of said secondary screen from rising, and wherein said weight of concrete again urges said second end in said first downward direction, thereby creating a repeating oscillating pattern of up and down movement by said second end of said secondary screen sufficient to urge said object off of said secondary screen.

4. The secondary screen of claim 3 wherein said means for applying a force includes an elastomer.

5. The secondary screen of claim 1 wherein said secondary screen includes a first upraised side attached to said secondary screen at a first side of said secondary screen and wherein said secondary screen includes a second upraised side attached to said secondary screen at a side of said secondary screen that is opposite with respect to said first side.

* * * * *